US006309234B1

(12) United States Patent
Hattori et al.

(10) Patent No.: US 6,309,234 B1
(45) Date of Patent: Oct. 30, 2001

(54) JOINT CONNECTOR

(75) Inventors: Yukimitsu Hattori; Mitsuhiko Matsuoka, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/610,681

(22) Filed: Jul. 7, 2000

(30) Foreign Application Priority Data

Jul. 8, 1999 (JP) ..... 11-194585

(51) Int. Cl.[7] ..... H01R 29/00; H01R 4/24; H01R 4/26; H01R 11/20

(52) U.S. Cl. ..... 439/189; 430/507

(58) Field of Search ..... 439/174, 403, 439/386, 189, 402, 459, 527, 574, 92, 95, 595, 603, 507, 509, 510

(56) References Cited

U.S. PATENT DOCUMENTS

| | | | |
|---|---|---|---|
| 5,120,235 | | 6/1992 | Kashiwa . |
| 5,356,302 | | 10/1994 | Inoue et al. . |
| 5,399,098 | | 3/1995 | Marshall et al. . |
| 5,741,147 | * | 4/1998 | Konoya et al. ..... 439/189 |

FOREIGN PATENT DOCUMENTS 61165973 7/1986 (JP) .

* cited by examiner

*Primary Examiner*—Brian Sircus
*Assistant Examiner*—Chandrika Prasad
(74) *Attorney, Agent, or Firm*—Greenblum & Bernstein, P.L.C.

(57) ABSTRACT

A joint connector is provided that includes a plurality of divisional joint connectors and a joint terminal. Each divisional joint connector includes a case having a pressure contact terminal and at least one opening. The pressure contact terminal has a wire connection portion and a terminal contact portion. The wire connection portion has at least one pressure contact blade configured to make pressure contact with a wire extending from a wire harness subassembly. The joint terminal extends into the respective openings, and is connected to a respective one of the terminal contact portions of the pressure contact terminals that are accommodated respectively in the cases of the divisional joint connectors. Consequently, electrical connection is made between the wires extending from a plurality of the wire harness subassemblies. With the above construction, it is possible to eliminate terminal fittings which have to be assembled subsequently in final harness assembly of a complete wire harness and to reduce the number of wires to be connected to the joint connector.

14 Claims, 4 Drawing Sheets

JOINT CONNECTOR

BACKGROUND OF THE INVENTION

1. Field of the Invention

The present invention relates to a joint connector, in particular for use in an automotive wire harness.

2. Description of Related Art

Generally, when an automotive wire harness is manufactured, first a wire harness subassembly is produced from a relatively small number of electric wires on a subassembly board, and then a complete wire harness is produced by combining a plurality of the wire harness subassemblies on a final assembly board. FIGS. 5 and 6 depict a conventional joint connector 3 used to make electrical connection between electric wires W that extend from wire harness subassemblies A, B, C. The joint connector 3 has a joint bus bar 2 with a plurality of terminal portions 2*a*.

The bus bar 2 is accommodated in a receptacle 1, into which a male connector 5 is to be inserted. The male connector 5 has a plurality of terminal insertion chambers 5*a* for accommodating terminal fittings 4. Each terminal fitting 4 is crimped to one end of the wire W, and fixedly inserted within the terminal insertion chamber 5*a*.When the male connector 5 is moved into engagement with the joint connector 3, the terminal fittings 4 contact the terminal portions 2*a* respectively to make electrical connection between the wires W.

The wires W have a wire W-1 that extends independently of the wire harness subassemblies A, B, C. The wire W-1 has one end connected to the connector 5 and the other end connected to a grounding terminal 6, thereby grounding the remaining wires W extending from the subassemblies A, B, C. Although the joint connector 3 of the above construction is used for the grounding connection, it would also be useful in other applications, e.g. where electrical connection is made merely between electrical circuits.

Wires W-2 that extend from the sub-assembly A are connected to both the male connector 5 and the joint connector 3 during subassembly. However, wires W-3, W-4 that extend from the sub-assemblies B, C are connected to the connector 5 subsequently on the final assembly board (not shown). The terminal fittings 4 as indicated by black circles in FIG. 6 are the ones which are subsequently connected to the connector 5 during final assembly.

The prior art joint connector as described above has the following problems.

First, the number of terminal fittings has to be assembled separately and subsequently on the final assembly board, thereby making the overall assembly process cumbersome.

Second, until the terminal fittings are assembled subsequently in the final assembly, they are exposed, hanging from the ends of the wires, which may result in damage to the fittings, or deformation thereof.

Third, each wire is terminated at one end by the terminal fitting, forming an electrical circuit, and has to be connected to the joint connector separately, thereby increasing the number of wires to be connected.

Fourth, terminating the wires with the terminal fittings; connecting them to the male connector; and connecting it to the joint connector is a very tedious and time-consuming operation, and increases the size of the joint connector as a whole.

SUMMARY OF THE INVENTION

The present invention has been developed after taking the above problems and/or other associated problems into consideration, and aims, among other things, to eliminate the terminal fittings which have to be assembled separately and subsequently in the final harness assembly, and to reduce the number of wires to be connected to the joint connector.

To solve the above problems and/or other associated problems, the present invention provides a joint connector provided with a plurality of divisional joint connectors and a joint terminal. Each divisional joint connector includes a case having at least one opening and a pressure contact terminal accommodated in the case. The pressure contact terminal has a wire connection portion and a terminal contact portion.

The wire connection portion has at least one pressure contact blade configured to make pressure contact with a wire extending from a wire harness subassembly. The joint terminal has a joint portion that extends into the at least one opening of each case. The joint portion is connected to a respective one of the terminal contact portions to make electrical connection between a plurality of the pressure contact terminals.

In accordance with this construction of the present invention, the wires can be brought into pressure contact with the pressure contact terminal within the divisional joint connector during subassembly. Hence, the conventional step of assembling the terminal fittings subsequently in the final assembly of a complete wire harness can be eliminated. Since the subsequently assembled terminal fittings can be eliminated, damage thereto or deformation thereof is prevented, thereby increasing the reliability of electric contact.

Furthermore, an intermediate portion of each wire can be connected to the divisional joint connector rather than to an end thereof, as is the case with the prior joint connector. Therefore, two circuits can be formed, one circuit at each side of the intermediate portion of the wire. The two circuits may then be connected to the joint connector. As a result, to connect two circuits, only one wire is required to be connected to the divisional joint connector, thereby reducing by half the number of wires to be connected to the divisional joint connector. This is a significant improvement, compared to the conventional case where two wires are connected to the joint connector to provide a common electrical connection for two circuits.

In another aspect of the present invention, the pressure contact terminal is generally L-shaped. One leg of the L-shape forms the wire connection portion, and extends upwardly from the other leg of the L-shape which forms the terminal contact portion. Additionally, the joint portion contacts a lower surface of a respective one of the terminal contact portions.

In a further aspect of the present invention, the case includes seating portions that are formed in spaced-apart relation. The pressure contact terminal is securely fixed on those portions in such a manner as to leave a space thereunder. The space at least partially aligns with the at least one opening so that the joint portion can extend into the space to contact the lower surface of a respective one of the terminal contact portions.

In a further aspect of the present invention, the case further includes a locking projection formed in the space. The locking projection urges the joint portion upwardly, so that the joint portion can be tightly engaged between the lower surface of a respective one of the terminal contact portions and the locking projection of a respective one of the cases. Preferably, a plurality of spaced-apart bent portions are formed on the joint portion to contact the lower surface of a respective one of the terminal contact portions.

In another aspect of the present invention, the joint terminal is a one-piece member formed from an elongated, planar metal sheet.

In a further aspect of the present invention, the joint terminal further includes a grounding terminal portion at one end of the joint portion, the grounding terminal portion projecting externally of one of the divisional joint connectors for grounding connection.

In yet another aspect of the present invention, the divisional joint connectors are juxtaposed so that the openings are aligned in registry with one another. The joint terminal extends into the openings to contact the pressure contact terminals that are accommodated respectively within the cases of the divisional joint connectors.

Moreover, the present invention provides a wire harness provided with a plurality of wire harness subassemblies, a joint connector, and a joint terminal. More specifically, the joint connector has a plurality of divisional joint connectors. Each divisional joint connector includes a pressure contact terminal having a wire connection portion and a terminal contact portion. The wire connection portion has at least one pressure contact blade that makes pressure contact with a wire extending from the wire harness subassembly. The joint terminal has a joint portion that is connected to a respective one of the terminal contact portions, thereby making electrical connection between the wires extending from the wire harness subassemblies.

BRIEF DESCRIPTION OF THE DRAWINGS

The present invention is further detailed in the description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
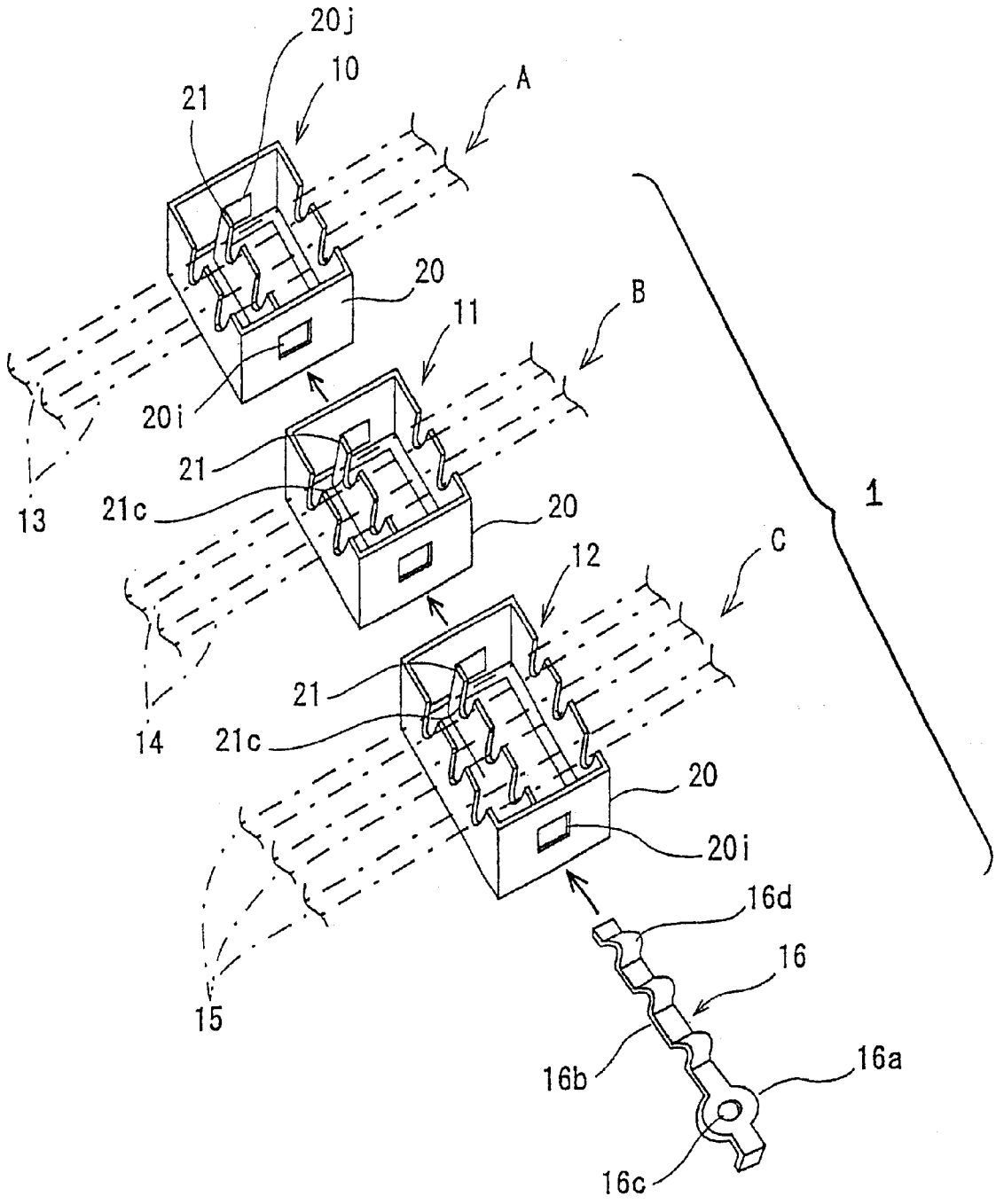
FIG. 1 is an exploded perspective view of a joint connector according to an embodiment of the present invention.
Figure 2:
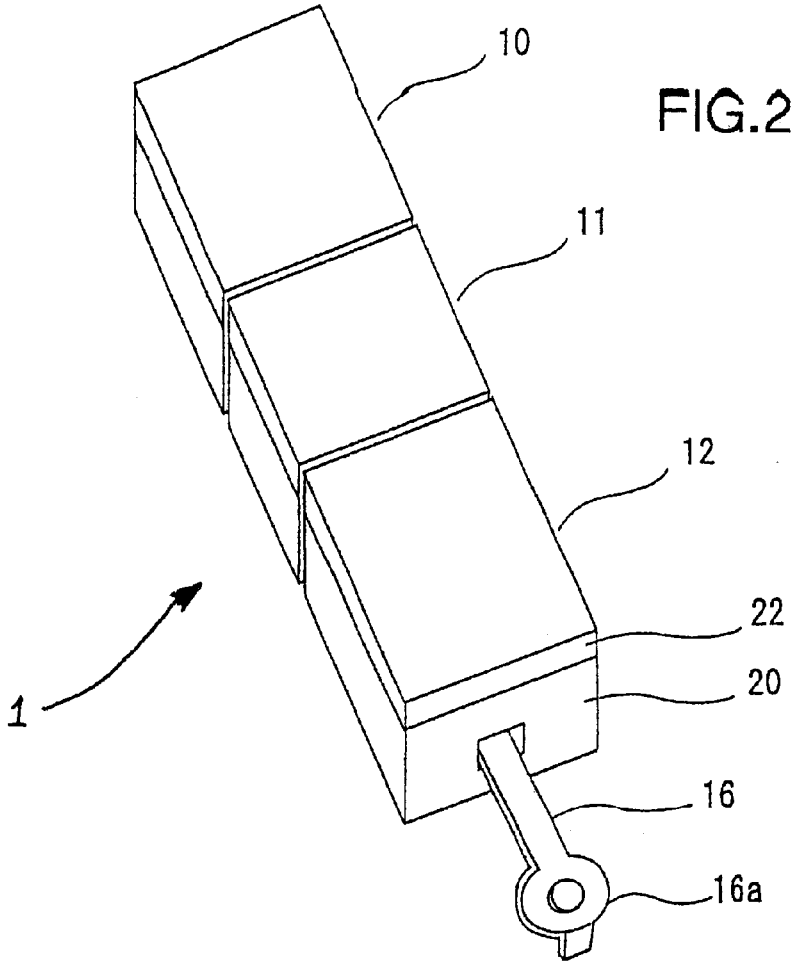
FIG. 2 is a perspective view of divisional joint connectors which are shown in FIG. 1 and which are fully assembled to form the joint connector. The details of the joint connector, e.g., wires mounted within the respective divisional joint connector are omitted to improve clarity of the drawing.
Figure 3:
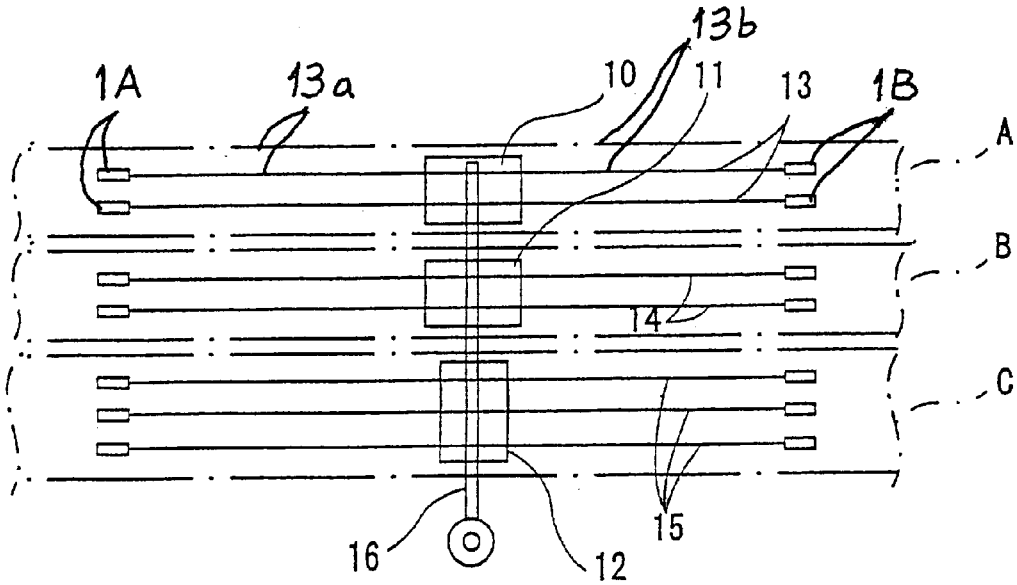
FIG. 3 is a schematic view illustrating how the wires contact the joint connector shown in FIG. 1.

FIGS. 1–3 depict a joint connector 1 including a plurality of divisional joint connectors 10, 11, 12, which are connected respectively to wires 13, 14, 15 for grounding connection. The wires 13, 14, 15 extend from wire harness subassemblies A, B, C. A joint terminal 16, having a grounding terminal portion 16*a* at one end, is provided for connection to the wires 13, 14, 15.

The divisional joint connectors 10, 11, 12 are of similar construction, and each has a pressure contact terminal 21 fixed within a lower case 20. Therefore, description is only given to the construction of the divisional joint connector 10.

Figure 4A:
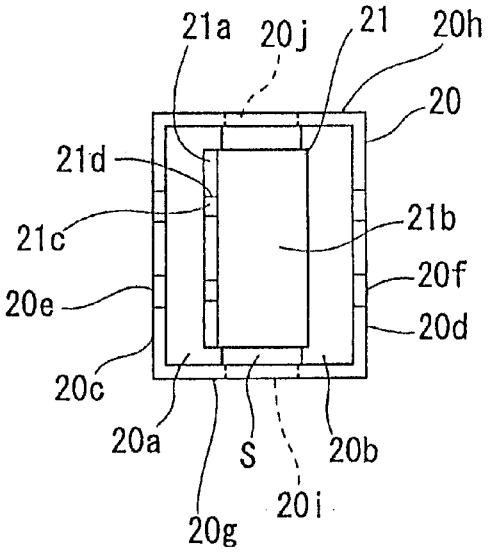
FIG. 4(A) is a plan view of the divisional joint connector.
Figure 4B:
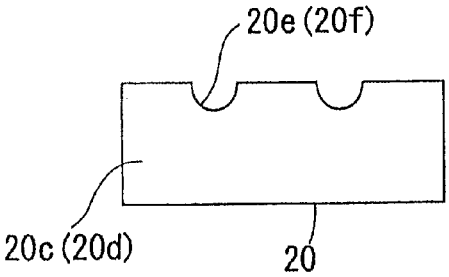
FIG. 4(B) is a side view of the divisional joint connector.
Figure 4C:
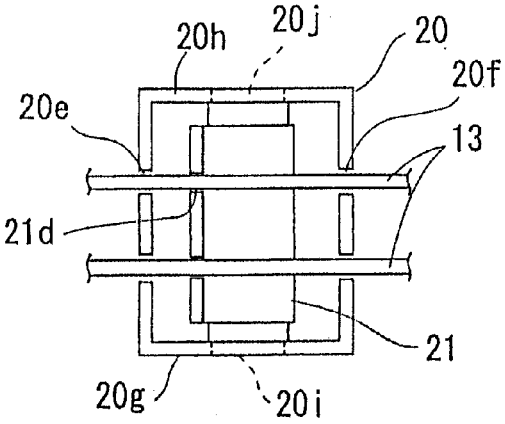
FIG. 4(C) is a plan view illustrating how the wires are mounted within the divisional joint connector.
Figure 4D:
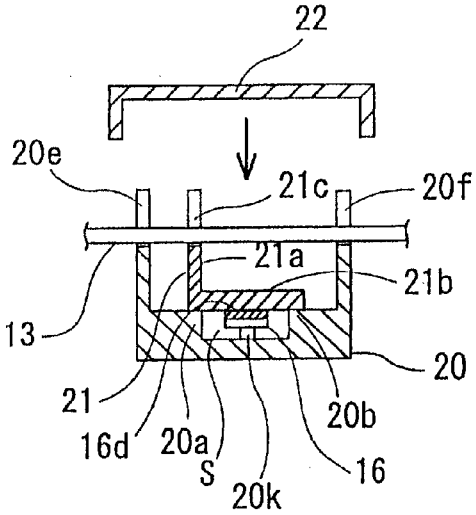
FIG. 4(D) is a sectional view illustrating a joint terminal extending in the divisional joint connector.
Figure 5:
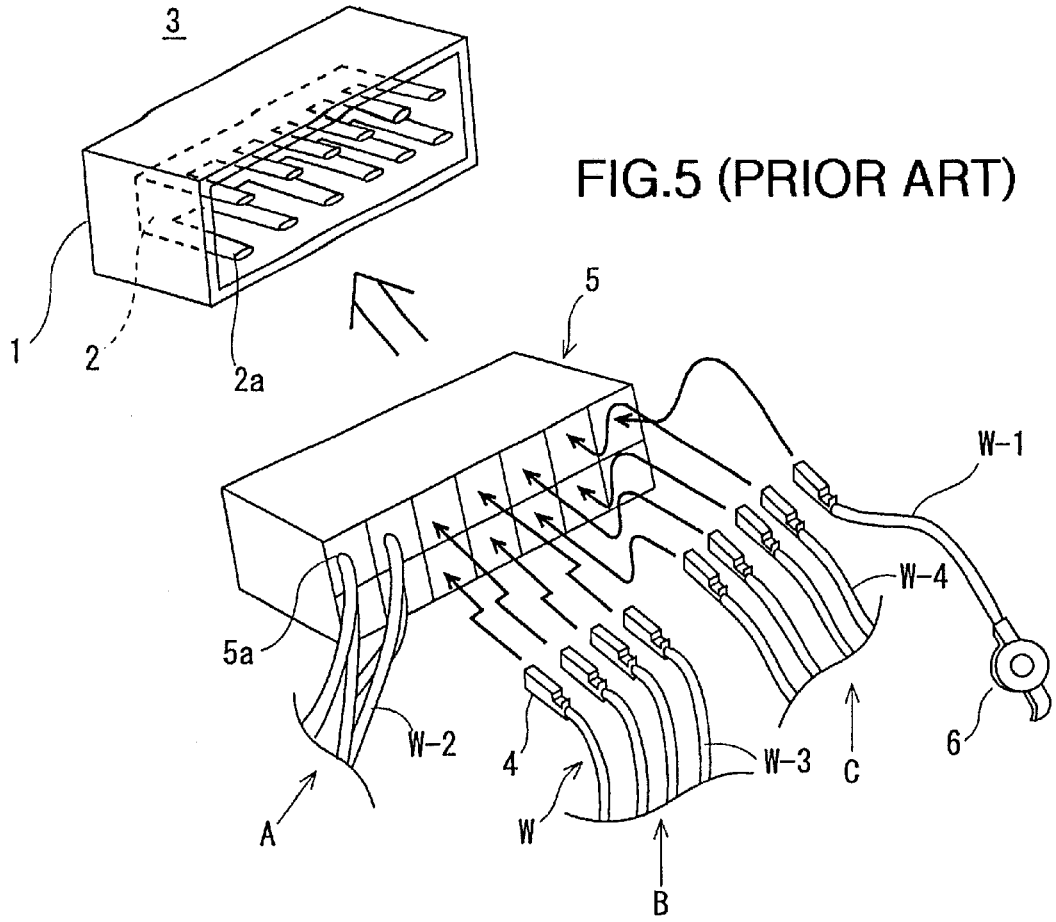
FIG.5 (PRIOR ART)
FIG. 5 is an exploded perspective view of a conventional embodiment.
Figure 6:
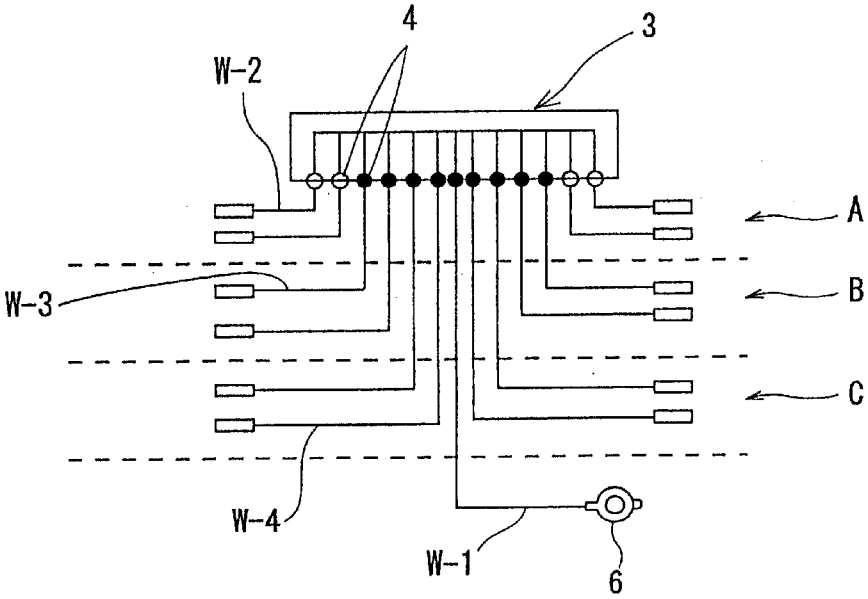
FIG.6 (PRIOR ART)
FIG. 6 is a schematic view illustrating how the wires contact a conventional joint connector.

The lower case 20 of each divisional joint connector is formed of any suitable insulating material, for example a resin material, and can be formed in any suitable manner, such as by molding. As shown in FIGS. 4(A), 4(C) and 4(D), the pressure contact terminal 21, which is formed of any suitable conductive material, such as metal, has a wire connection portion 21*a,* and a terminal contact portion 21*b*. Preferably, the pressure contact terminal 21 is L-shaped. The wire connection portion 21*a* may be in the form of a vertically extending portion, and the terminal contact portion 21*b* may be in the form of a horizontally extending portion that is bent from the lower end of the wire connection portion 21*a*. The wire connection portion 21*a* has a plurality of slots 21*d,* each slot formed with a contact pressure blade 21*c*. The slots 21*d* are spaced a predetermined distance on the upper surface of the connection portion 21*a*. As shown in FIG. 4(D), the terminal contact portion 21*b* is fixedly mounted on seating portions 20*a,* 20*b* that are formed in spaced-apart relation in the lower case 20. The terminal contact portion 21*b* may be fixedly mounted on the seating portions 20*a,* 20*b* in any suitable manner, for example by adhesive, mechanical fasteners, inserting molding, etc. A space S is created under the central region of the terminal contact portion 21*b* of the pressure contact terminal 21 and between the seating portions 20*a,* 20*b*.

As shown in FIGS. 4(A)–(D), the lower case 20 is generally box-shaped, having first opposed side walls 20*c,* 20*d* and second opposed side walls 20*g,* 20*h*. The first opposed side walls 20*c,* 20*d* have wire receiving grooves 20*e,* 20*f* that are formed by cutting out the upper ends thereof. The second opposed side walls 20*g,* 20*h* have openings 20*i,* 20*j* that correspond to and align with the space S. The openings 20*i,* 20*j* may be in the form of through holes. A locking projection 20*k* is formed to project into the space S to engage the joint terminal 16 in a manner to be described below.

Preferably, the locking projection 20*k* is formed unitarily and in one piece with the lower case 20 to project from the bottom surface of the lower case 20. Of course, the locking projection 20*k* may be formed as a separate element and attached to the bottom surface of the lower case 20 in any conventional manner. Alternatively, the locking projection 20*k* may be formed as a resilient lance in a manner well known in the field of electrical connectors.

Wires 13 are inserted in the wire receiving grooves 20*e,* 20*f* of the lower case 20, and then pressed in the slots 21*d* of the pressure contact terminal 21 by a jig. At this point, each of the pressure contact blades 21*c* cuts into the insulation of the wires 13 to establish contact with the core of the wires 13. Preferably, the contact blade 21*c* contacts the core at a location between ends of the wire 13, or at the intermediate portion of the wire 13, so that two electrical circuits can be formed, one circuit at each side of the contact location.

After the wires 13 have been mounted in the pressure contact terminals 21, an upper case 22 (FIG. 4(D)) is firmly attached to the lower case 20. The upper case 22 is formed of the same or similar material to that of the lower case 20, and in a similar manner. In this way, the wires 13 of the wire harness subassembly A are connected to the divisional joint connector 10. Similarly, wires 14, 15 of the wire harness subassemblies B, C are connected to the divisional connectors 11, 12 respectively.

As shown in FIG. 1, the joint terminal 16 is a one-piece member formed from an elongated, planer metal sheet, and has a grounding terminal portion 16*a* with a bolt insertion hole 16*c*. The terminal portion 16*a* extends from one end of a joint portion 16*b*. The joint portion 16*b* has a plurality of bent portions 16*d* spaced at predetermined locations, each portion 16*d* being formed into a substantial V shape. The openings 20*i*, 20*j* on the lower case 20 are dimensioned for receiving the joint terminal 16.

The operation of the joint connector of the present invention is described below.

The wires 13, 14, 15 of the wire harness subassemblies A, B, C are connected to the divisional joint connectors 10, 11, 12 prior to final assembly of a complete wire harness. As shown in FIG. 1, when those subassemblies A, B, C are assembled on a final assembly board (not shown), the connectors 10, 11, 12 are juxtaposed such that the openings 20*i*, 20*j* on the lower cases 20 are aligned in registry with one another. The divisional joint connectors 10, 11, 12 may be assembled together with suitable latching devices (not shown). Under this condition, the joint portion 16*b* of the joint terminal 16 is inserted into the openings 20*i*, 20*j*, passing through the space S. The joint portion 16*b* is inserted to extend in a direction substantially perpendicular to the longitudinal direction that the wires 13, 14, 15 extend.

The upper ends of the respective bent portions 16*d* urge the lower surfaces of the respective terminal contact portions 21*b*, thereby making electrical connection between the pressure contact terminals 21 that are accommodated respectively within the cases of the divisional joint connectors 10, 11, 12. Additionally, the respective locking projections 21*k* urge the lower surface of the joint portion 16*b* upwardly so that the joint terminal 16 can be firmly fixed in position within the divisional joint connectors 10, 11, 12. More specifically, the joint portion 16*b* is tightly engaged between the lower surface of a respective one of the terminal contact portions 21*b* and the locking projection 20*k* of a respective one of the lower cases 20.

When the grounding terminal portion 16*a* of the joint terminal 16 is connected to a grounding surface such as a vehicle body panel, the wires 13, 14, 15 (which are electrically connected to the joint terminal 16) are grounded.

With the above construction, all the wires 13, 14, 15 (which are to be connected to the joint connector) are connected to the divisional joint connectors 10, 11, 12 during subassembly, thereby eliminating the necessity of assembling terminal fittings subsequently in the final assembly.

Furthermore, as shown in FIG. 3, the intermediate portion of each of the wires 13, 14, 15 is connected to the pressure contact terminal 21. Accordingly, for the wires 13, for example, two electrical circuits 13*a*, 13*b*, each circuit provided with a wire 13*a*, 13*b* associated with a terminal fitting 1A, 1B at a respective end thereof, are formed at opposite sides of the intermediate portion, and are connected to a ground. As a result, compared to the prior art case, the number of wires required is halved.

Still further, only the insertion operation of the joint terminal 16 is required to assemble the joint connector in the final assembly. Consequently, the overall joint connector assembly becomes easier.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI 11-194585, filed on Jul. 8, 1999, which is herein expressly incorporated by reference in its entirety.

What is claimed is:

1. A joint connector comprising:

a plurality of divisional joint connectors, each said divisional joint connector comprising a case having at least one through hole and a pressure contact terminal accommodated in said case, said pressure contact terminal having a wire connection portion and a terminal contact portion, said wire connection portion having at least one pressure contact blade configured to make pressure contact with a wire extending from a wire harness subassembly; and a joint terminal having a joint portion that extends into and passes through said at least one through hole of each said case, said joint portion connected to a respective one of said terminal contact portions to make electrical connection between a plurality of said pressure contact terminals.

2. The joint connector according to claim 1, wherein each said pressure contact terminal is generally L-shaped, one leg of the L-shape forming said wire connection portion and extending upwardly from the other leg of the L-shape which forms said terminal contact portion.

3. The joint connector according to claim 2, wherein said joint portion contacts a lower surface of a respective one of said terminal contact portions.

4. The joint connector according to claim 2, wherein each said case comprises seating portions in spaced-apart relation, wherein said pressure contact terminal is fixedly mounted on said seating portions in such a manner as to leave a space thereunder, said space at least partially aligning with said at least one through hole, said joint portion extending in said space to contact a lower surface of a respective one of said terminal contact portions.

5. The joint connector according to claim 4, wherein each said case further comprises a locking projection formed in said space, said locking projection urging said joint portion upwardly such that said joint portion is tightly engaged between said lower surface of a respective one of said terminal contact portions and said locking projection of a respective one of said cases.

6. The joint connector according to claim 5, wherein said joint portion comprises a plurality of space-apart bent portions that directly contact said terminal contact portions.

7. The joint connector according to claim 1, wherein said joint terminal is a one-piece member that is formed from an elongated, planar metal sheet.

8. The joint connector according to claim 7, wherein said joint terminal further comprises a grounding terminal portion at one end of said joint portion, said grounding terminal portion projecting externally of one of said divisional joint connectors for grounding connection.

9. The joint connector according to claim 1, wherein said divisional joint connectors are juxtaposed such that said through holes are aligned in registry with one another, said joint portion extending in said through holes to contact said terminal contact portions.

10. A wire harness comprising:

a plurality of wire harness subassemblies;

a joint connector having a plurality of divisional joint connectors, each said divisional joint connector comprising a pressure contact terminal having a wire connection portion and a terminal contact portion, said wire connection portion having at least one pressure contact blade that makes pressure contact with a wire extending from each said wire harness subassembly; and a joint terminal having a joint portion, wherein said joint portion is connected to a respective one of said terminal contact portions to make electrical connection between said wires extending from said wire harness subassemblies, wherein each said pressure contact terminal is generally L-shaped, one leg of the L-shape forming said wire connection portion and extending upwardly from the other leg of the L-shape which forms said terminal contact portion, wherein said joint portion contacts a lower surface of a respective one of said terminal contact portions.

11. The wire harness according to claim 10, wherein each said pressure contact blade contacts a core of said wire at a location between opposed ends of said wire.

12. The wire harness according to claim 11, wherein each said divisional joint connector further comprises a case having at least one opening, said pressure contact terminal accommodated in said case, said joint portion extending in said openings to contact a respective one of said terminal contact portions.

13. The wire harness according to claim 12, wherein said divisional joint connectors are juxtaposed so that said openings are aligned in registry with one another.

14. The wire harness according to claim 10, wherein said joint terminal further comprises a grounding terminal portion at one end of said joint portion, said grounding terminal portion projecting externally of one of said divisional joint connectors for grounding connection.

* * * * *